US009470244B2

(12) United States Patent
Kato et al.

(10) Patent No.: US 9,470,244 B2
(45) Date of Patent: Oct. 18, 2016

(54) COMPRESSOR WITH COOLING FUNCTION

(71) Applicant: IHI Corporation, Koto-ku (JP)

(72) Inventors: Yoshiki Kato, Tokyo (JP); Atsushi Minegishi, Tokyo (JP); Toshimichi Taketomi, Tokyo (JP)

(73) Assignee: IHI Corporation, Koto-ku (JP)

( * ) Notice: Subject to any disclaimer, the term of this patent is extended or adjusted under 35 U.S.C. 154(b) by 412 days.

(21) Appl. No.: 14/134,623

(22) Filed: Dec. 19, 2013

(65) Prior Publication Data

US 2014/0105733 A1 Apr. 17, 2014

Related U.S. Application Data

(63) Continuation of application No. PCT/JP2012/066326, filed on Jun. 27, 2012.

(30) Foreign Application Priority Data

Jun. 28, 2011 (JP) ..... 2011-143031

(51) Int. Cl.

| | |
|---|---|
| ***F04D 29/58*** | (2006.01) |
| ***F04D 25/16*** | (2006.01) |
| ***F04D 29/66*** | (2006.01) |
| ***F04D 17/12*** | (2006.01) |

(52) U.S. Cl.

CPC ..... *F04D 29/5826* (2013.01); *F04D 17/12* (2013.01); *F04D 25/163* (2013.01); *F04D 29/663* (2013.01)

(58) Field of Classification Search

CPC ... F04D 29/5826; F04D 17/12; F04D 25/163
See application file for complete search history.

(56) References Cited

U.S. PATENT DOCUMENTS

| | | | | |
|---|---|---|---|---|
| 3,001,692 | A * | 9/1961 | Schierl | F04D 29/5826 415/122.1 |
| 4,125,345 | A * | 11/1978 | Yoshinaga | F04D 17/12 415/179 |
| 2003/0059299 | A1* | 3/2003 | Miura | F04D 29/5826 415/179 |
| 2006/0185334 | A1* | 8/2006 | Taketomi | B01D 46/002 55/490 |
| 2009/0320283 | A1 | 12/2009 | Taketomi et al. | |

FOREIGN PATENT DOCUMENTS

| | | |
|---|---|---|
| CN | 1122630 A | 5/1996 |
| CN | 1221077 A | 6/1999 |
| JP | 53-27865 B2 | 8/1978 |

(Continued)

OTHER PUBLICATIONS

International Search Report mailed Oct. 2, 2012 for PCT/JP2012/066326 filed on Jun. 27, 2012 with English Translation.
International Written Opinion mailed Oct. 2, 2012 for PCT/JP2012/066326 filed on Jun. 27, 2012.
Extended Search Report issued Dec. 4, 2014 in European Patent Application No. 12805286.7.

(Continued)

*Primary Examiner* — Woody Lee, Jr.
(74) *Attorney, Agent, or Firm* — Oblon, McClelland, Maier & Neustadt, L.L.P

(57) ABSTRACT

The inner wall surfaces on the discharge sides of a cooling area have arc-like curved surfaces. The curvature of upper-side inner wall surfaces above a boundary part and the curvature of lower-side inner wall surfaces below the boundary part are set to be different from one another, the boundary part being located above the center line of cooling devices.

3 Claims, 10 Drawing Sheets

(56) References Cited

FOREIGN PATENT DOCUMENTS

| | | | |
|---|---|---|---|
| JP | 2003-328998 | | 11/2003 |
| JP | 3470410 | B2 | 11/2003 |
| JP | 2005-248832 | A | 9/2005 |
| JP | 4483194 | B2 | 6/2010 |
| KR | 2003-0026202 | A | 3/2003 |

OTHER PUBLICATIONS

Office Action issued Dec. 15, 2015 in Korean Patent Application No. 10-2014-7000300 (with English translation).
Combined Office Action and Search Report issued Jul. 2, 2015 in Chinese Patent Application No. 201280031378.7 (with English language translation).

* cited by examiner

COMPRESSOR WITH COOLING FUNCTION

CROSS REFERENCE TO RELATED APPLICATIONS

This application is a continuation application of International Application No. PCT/JP2012/066326, filed on Jun. 27, 2012, which claims priority to Japanese Patent Application No. 2011-143031, filed on Jun. 28, 2011, the entire contents of which are incorporated by references herein.

BACKGROUND OF THE INVENTION

1. Field of the Invention

The present invention relates to a compressor to be used as a power source in a manufacturing facility or as a process compressor, and particularly to a compressor with cooling function for cooling compressed air.

2. Description of the Related Art

As described in Japanese Patent No. 3470410 (Patent Literature 1), a two-stage turbo compressor has been known, as an industrial turbo compressor, in which fluid compressed by a first-stage compressor is further compressed by a second-stage compressor and then discharged. In this turbo compressor, an impeller of the first-stage compressor and an impeller of the second-stage compressor are connected to each other with a rotary shaft, and the rotary shaft is rotated by a drive motor through a gear system. Specifically, the above-described rotary shaft is disposed parallel to an output shaft of the drive motor, and a gear of the gear system is meshed with a central portion of the rotary shaft. Further, the impeller of the first-stage compressor is attached to an end portion of the rotary shaft on the drive motor side, and the impeller of the second-stage compressor is attached to the other end of the rotary shaft.

Moreover, an intercooler is provided between the first-stage compressor and the second-stage compressor, and an after-cooler is provided downstream of the second-stage compressor. Further, air compressed by the first-stage compressor is cooled by the intercooler and then recompressed by the second-stage compressor. The air compressed by the second-stage compressor is cooled by the after-cooler to be discharged to the outside.

SUMMARY OF THE INVENTION

When the air compressed by a compressor is cooled by cooling means of the intercooler or the after-cooler, the saturation vapor pressure decreases, and therefore water condenses in a casing of the cooling means. Further, the condensed water accumulates in a lower portion of the casing and is discharged from an outlet. In the compressor according to Patent Literature 1, the shape of the casing is not appropriate. Accordingly, the flow of compressed air flowing into the cooling means becomes turbulent. This turbulence causes a decrease in cooling efficiency. Moreover, the following phenomenon occurs: the compressed air flowing into the cooling means locally flows fast, and the fast flow raises the condensed water accumulating in the casing, and carries the condensed water to the downstream side.

The present invention has been accomplished to solve the above-described problems. An object of the present invention is to provide a compressor with cooling function which includes a cooling device with improved cooling efficiency.

In order to achieve the foregoing object, a compressor with cooling function according to an embodiment of the present invention, comprises: a compressing device to be rotationally driven by a drive unit; and a cooling device configured to cool compressed air ejected from the compressing device, wherein the cooling device comprises: a case having a cooling area inside; an inlet provided in an upper surface of the case, the inlet allowing compressed air ejected from the compressing device to flow in; an outlet provided in the upper surface of the case, the outlet allowing the compressed air to be discharged outside; a cooling device housed in the cooling area and configured to cool the compressed air; a partitioning wall partitioning a space around the cooling device in the cooling area into an inlet-side cooling area having the inlet and an outlet-side cooling area having the outlet; and a drain space configured to store condensed water produced from the compressed air cooled when passing through the cooling device, the outlet-side cooling area has an inner wall surface formed of an arc-like curved surface, the inner wall surface includes a first inner wall surface and a second inner wall surface defined by a boundary line being offset toward the inlet and the outlet from a center plane of the cooling device extending in a direction perpendicular to the partitioning wall, the first inner wall surface being an inner wall surface located on the same side as the inlet and the outlet, the second inner wall surface being an inner wall surface located on the same side as the drain space, and the first inner wall surface and the second inner wall surface have different curvatures.

DESCRIPTION OF THE PREFERRED EMBODIMENTS

Figure 1:
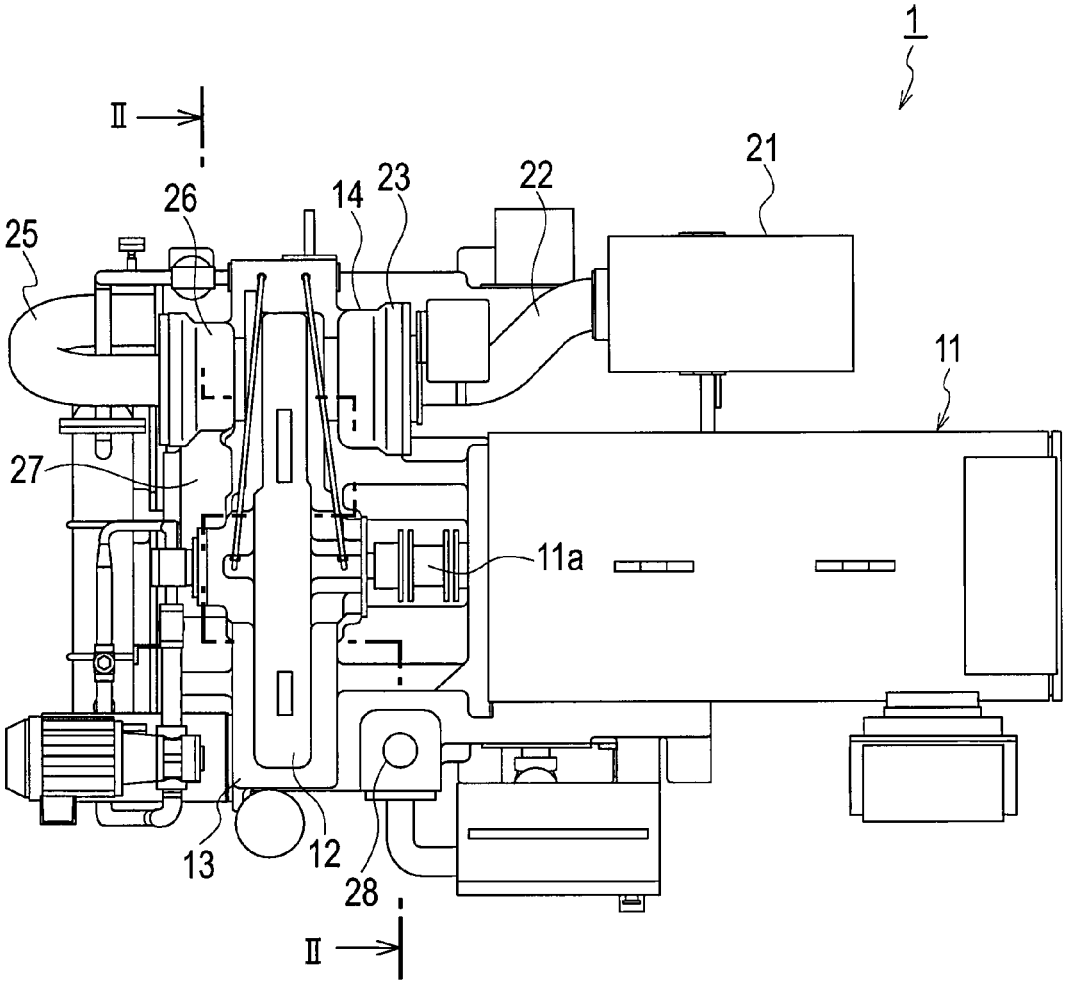
FIG. 1 is a plan view of a compressor with cooling function according to one embodiment of the present invention.
Figure 3:
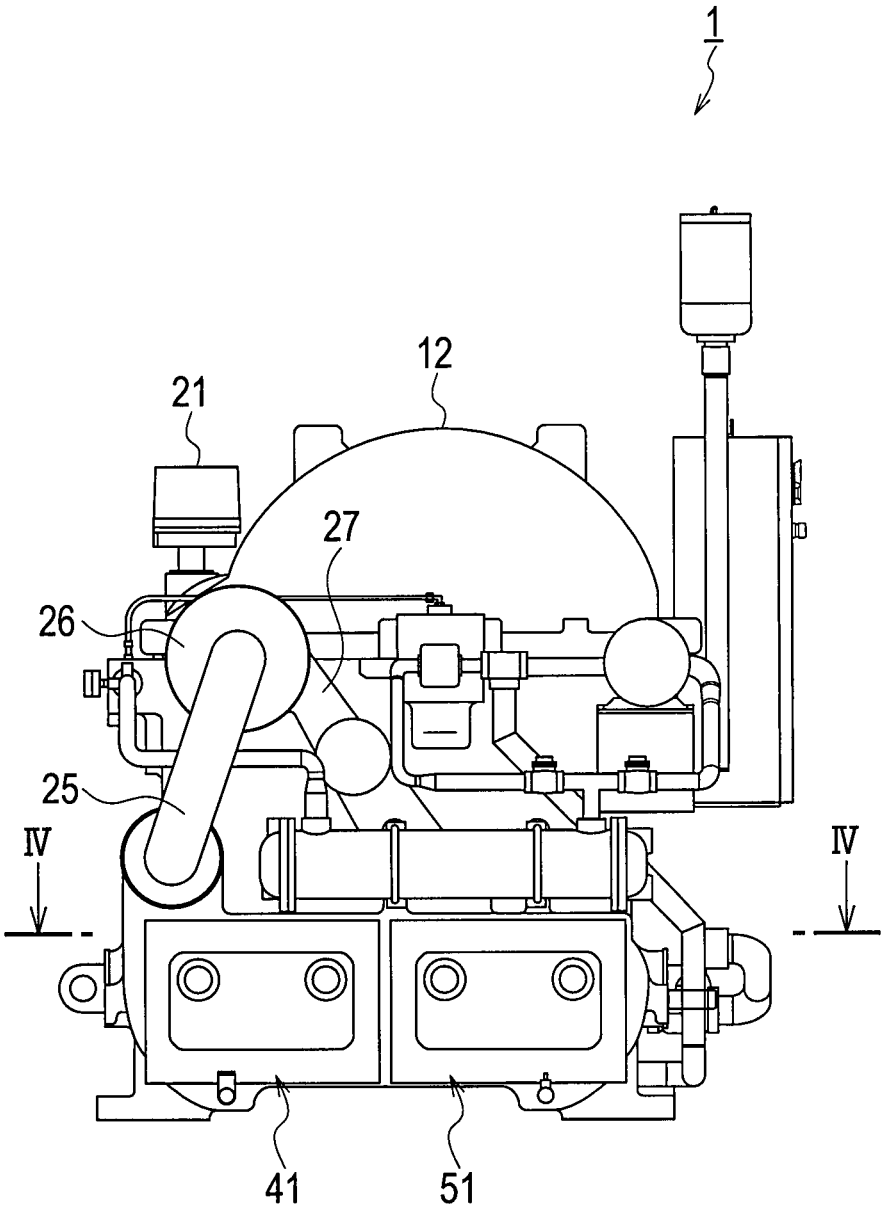
FIG. 3 is a front view of the compressor with cooling function in FIG. 1.

An embodiment of the present invention will be described with reference to the drawings. As shown in FIGS. 1 and 3, a compressor with cooling function 1 of this embodiment includes a drive motor 11, an inlet section 21, a lower pressure-side compressor 23, an intercooler 41, a higher pressure-side compressor 26, an after-cooler 51, and a gear system 12. The driving force of the drive motor 11 is transmitted via the gear system 12 to the lower pressure-side compressor 23 and the higher pressure-side compressor 26. Thus, the lower pressure-side compressor 23 and the higher pressure-side compressor 26 are driven. Air (gas) introduced from the inlet section 21 is first compressed in the lower pressure-side compressor 23. The compressed air is cooled in the intercooler 41 to be supplied to the higher pressure-side compressor 26. Then, the supplied air is further compressed in the higher pressure-side compressor 26 and then cooled in the after-cooler 51 to be discharged outside.

The gear system 12 housed in a gear case 13 has a rotary shaft (not shown) disposed parallel to an output shaft 11*a* of the drive motor 11. The lower pressure-side compressor 23 is provided at an end portion of the rotary shaft on the drive motor 11 side, and the higher pressure-side compressor 26 is provided at the other end portion of the rotary shaft. Further, the inlet section 21 and an inlet conduit 22 of the lower pressure-side compressor 23 are disposed parallel to the side of the drive motor 11. Each of the lower pressure-side compressor 23 and the higher pressure-side compressor 26 is a centrifugal compressor which compresses air axially drawn in and discharges the air radially, and is housed in a turbo case 14 with the rotary shaft.

Figure 2:
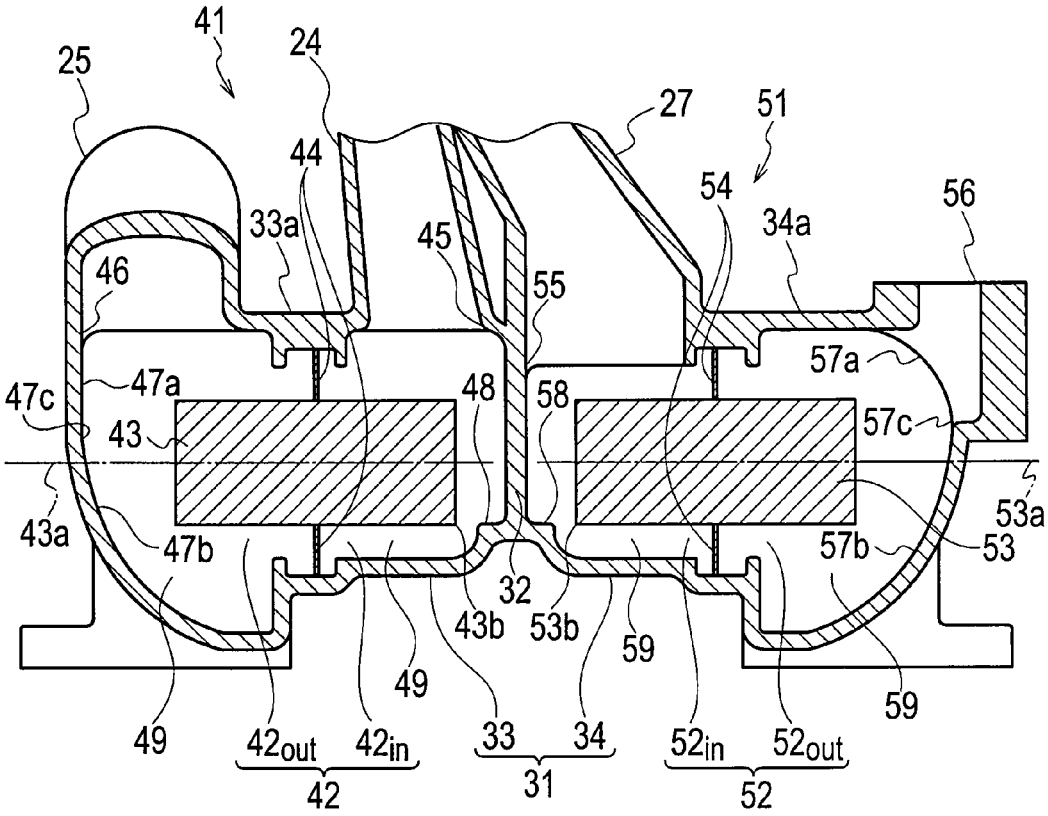
FIG. 2 is a cross sectional view taken along line II-II of FIG. 1.
Figure 4:
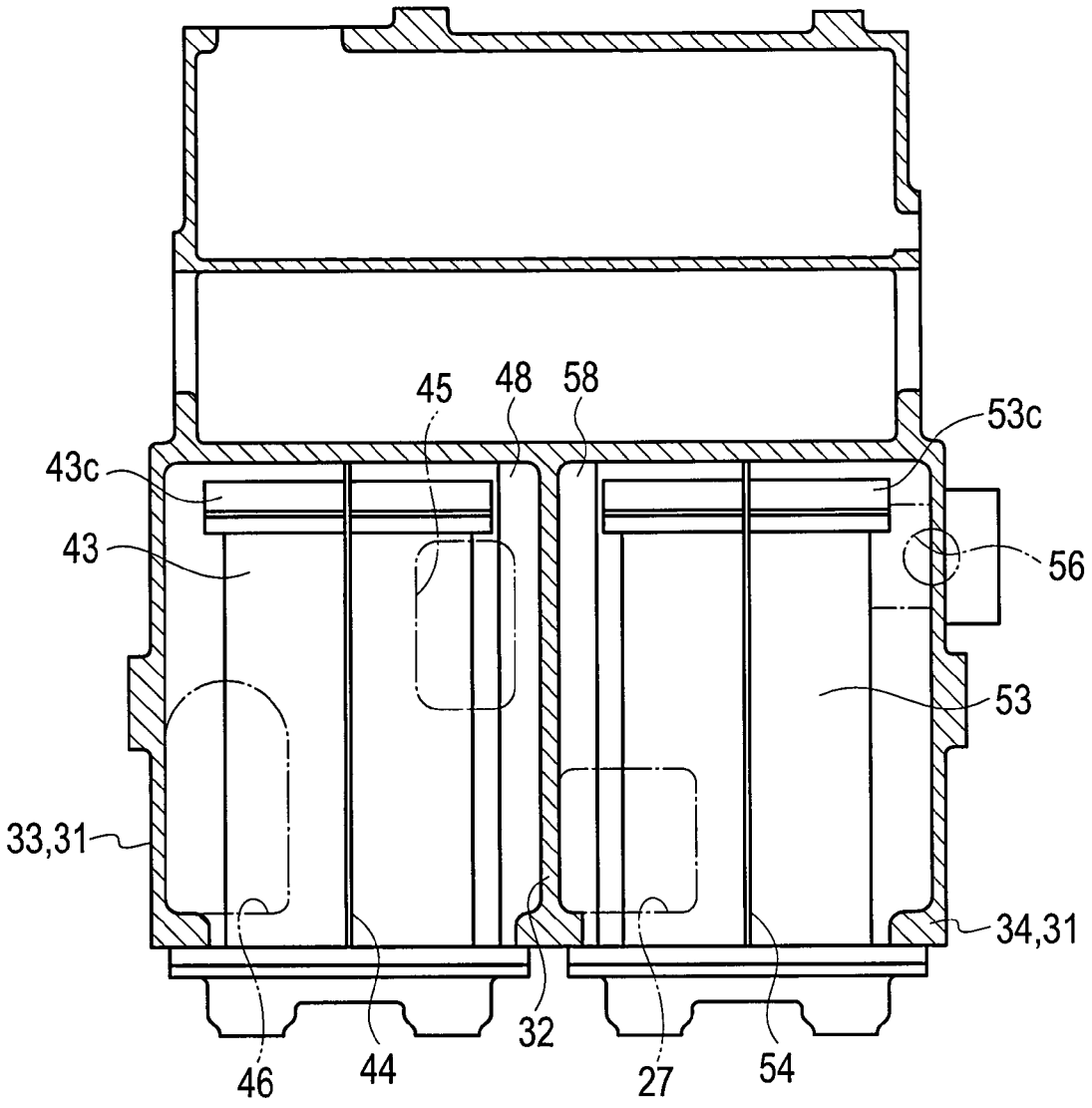
FIG. 4 is a cross sectional view taken along line IV-IV of FIG. 3.

The intercooler 41 and the after-cooler 51 are housed in a cooling case 31 as shown in FIG. 2, and disposed under the gear system 12, the lower pressure-side compressor 23, and the higher pressure-side compressor 26. The cooling case 31 has the shape of an approximately rectangular box, and also serves as abase for supporting the lower pressure-side compressor 23, the higher pressure-side compressor 26, the gear system 12, the drive motor 11, and the inlet section 21. Further, the cooling case 31 is formed integrally with the gear case 13 for housing the gear system 12 and the turbo case 14 for housing the lower pressure-side compressor 23 and the higher pressure-side compressor 26 by casting or the like. Moreover, as shown in FIGS. 2 and 4, in the cooling case 31, a lower pressure-side cooling case 33 and a higher pressure-side cooling case 34 are integrally formed. These cases 33 and 34 are partitioned by a division wall 32.

The intercooler 41 is cooling means for the lower pressure-side compressor 23, and includes the lower pressure-side cooling case 33 and a lower pressure-side cooling device 43.

Figure 5:
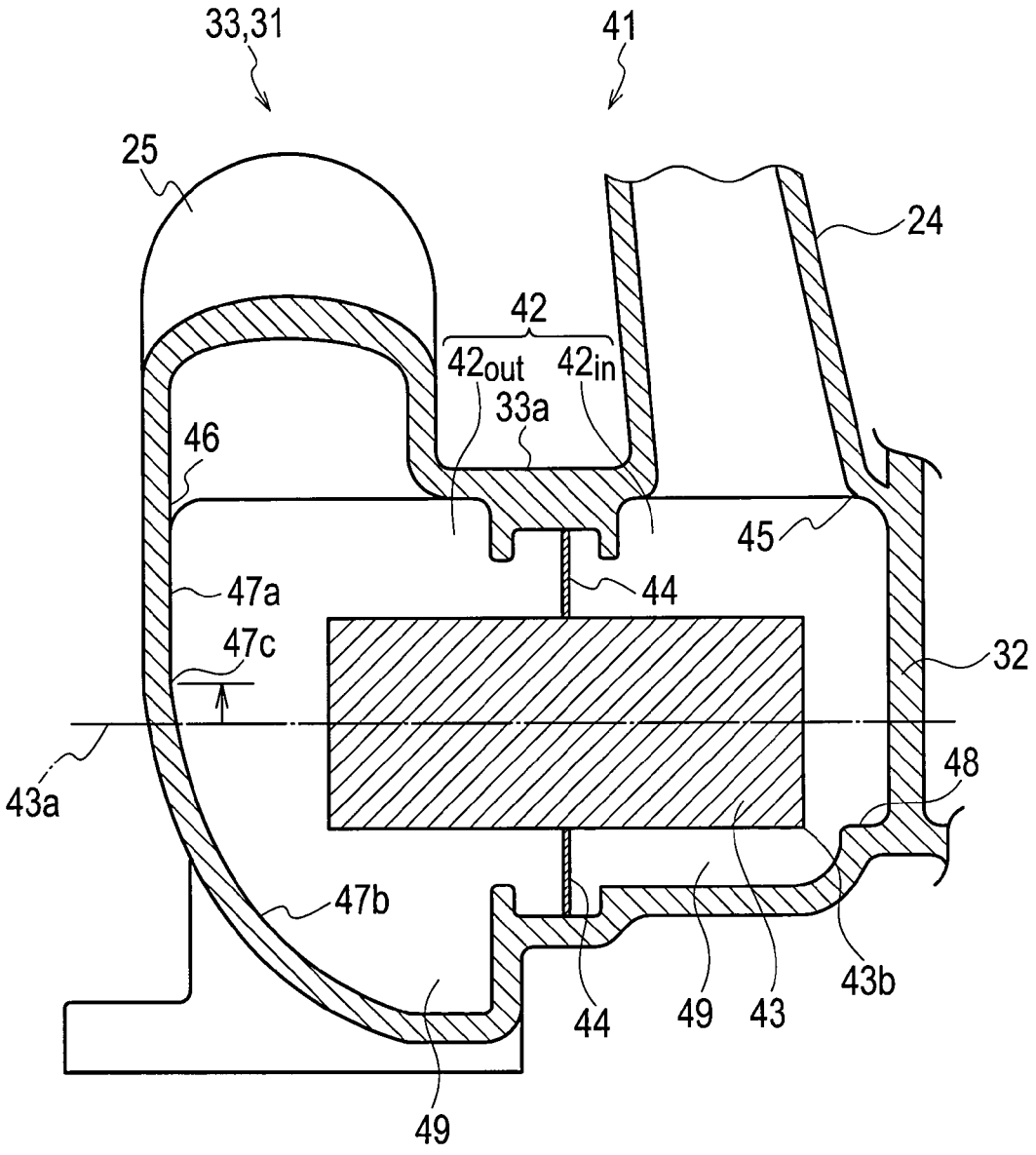
FIG. 5 is an enlarged view of a principal part of an intercooler in FIG. 2.

As shown in FIGS. 2, 4, and 5, the lower pressure-side cooling case 33 is formed in the shape of a box, and includes a lower pressure-side cooling area 42 inside. A case upper surface 33*a* of the lower pressure-side cooling case 33 has a lower pressure-side inlet 45 through which compressed air ejected from the lower pressure-side compressor 23 flows in and a lower pressure-side outlet 46 through which compressed air in the lower pressure-side cooling area 42 is discharged outside. Moreover, the lower pressure-side cooling area 42 has the lower pressure-side cooling device 43 provided therein.

The lower pressure-side cooling device 43 is inserted and installed in the lower pressure-side cooling area 42 from the bottom toward the top in FIG. 4. Further, in a state in which the lower pressure-side cooling device 43 is installed, a flow path of compressed air is formed along the horizontal direction (lateral direction in FIGS. 2 and 4) inside the lower pressure-side cooling area 42. Moreover, the lower pressure-side cooling device 43 has partitioning walls 44 on upper and lower surfaces and a forward end surface located in the direction of insertion. Further, the partitioning walls 44 partition a space around the lower pressure-side cooling device 43 into an inlet-side cooling area 42in including the lower pressure-side inlet 45 and an outlet-side cooling area 42out including the lower pressure-side outlet 46.

In the inlet-side cooling area 42in, a portion of the lower pressure-side cooling case 33 which faces an inlet-side lower edge portion 43*b* of the lower pressure-side cooling device 43 has a flow-smoother protrusion 48 formed such that a tip of the flow-smoother protrusion 48 is close to the inlet-side lower edge portion 43*b*. The distance between the inlet-side lower edge portion 43*b* of the lower pressure-side cooling device 43 and the flow-smoother protrusion 48 of the lower pressure-side cooling case 33 is preferably as small as possible. However, in this embodiment, a forward end flange portion 43*c* having larger dimensions than a cooling section through which compressed air passes is provided at the tip of the lower pressure-side cooling device 43 which is located in the direction of insertion. Accordingly, the distance between the inlet-side lower edge portion 43*b* and the flow-smoother protrusion 48 is set to a distance enough to prevent the forward end flange portion 43*c* from touching the flow-smoother protrusion 48 when the lower pressure-side cooling device 43 is assembled to the lower pressure-side cooling case 33. Thus, the direction of the flow of compressed air flowing into the inlet-side cooling area 42in is changed by the flow-smoother protrusion 48, and the compressed air flows into the lower pressure-side cooling device 43 without entering an undermentioned drain space 49.

In the lower pressure-side cooling area 42, the drain space 49 is formed under the lower pressure-side cooling device 43. The drain space 49 stores condensed water which has dropped from the lower pressure-side cooling device 43. The condensed water is produced from the compressed air cooled when passing through the lower pressure-side cooling device 43.

Figure 7A:
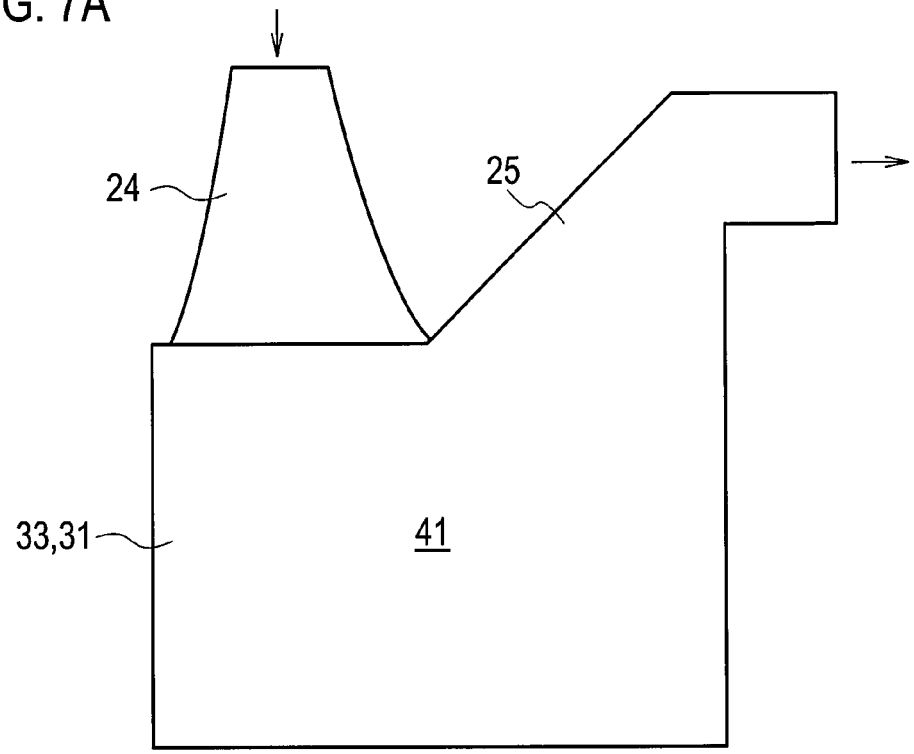
FIG. 7A is a side view of a lower pressure-side cooling case as viewed from the left in FIG. 1.

An inner wall surface of the outlet-side cooling area 42out is an arc-like curved surface extending from the drain space 49 to the case upper surface 33*a*. This arc-like curved surface includes an upper-side inner wall surface 47*a* and a lower-side inner wall surface 47*b* which are defined by a boundary part 47*c* set above a center line 43*a* (center plane extending in a direction perpendicular to the partitioning walls 44) of the lower pressure-side cooling device 43. Here, the curvature of the upper-side inner wall surface 47*a* is set smaller than the curvature of the lower-side inner wall surface 47*b*. In this embodiment, the upper-side inner wall surface 47*a* is a flat surface with a curvature of 0 and constitutes a surface along the vertical direction. Moreover, the lower pressure-side outlet 46 is provided on an extension of the upper-side inner wall surface 47*a*. As shown in FIG. 7A, a lower pressure-side outlet passage 25 leading from the lower pressure-side cooling area 42 to the outside is connected to the lower pressure-side outlet 46. Further, the lower pressure-side outlet passage 25 is formed to extend in the vertical direction along the upper-side inner wall surface 47*a* when viewed from the front and extend in a direction oblique to the vertical direction when viewed from the side. Accordingly, the direction of the flow of the compressed air which has passed through the lower pressure-side cooling device 43 is changed to an upward direction by the curve of the lower-side inner wall surface 47*b*. Thus, the compressed air is guided to the lower pressure-side outlet 46 along the upper-side inner wall surface 47*a* to be discharged from the lower pressure-side cooling area 42 through the lower pressure-side outlet passage 25 to the higher pressure-side compressor 26.

The after-cooler 51 is cooling means for the higher pressure-side compressor 26. Similar to the intercooler 41, the after-cooler 51 includes the higher pressure-side cooling case 34 and a higher pressure-side cooling device 53.

Figure 6:
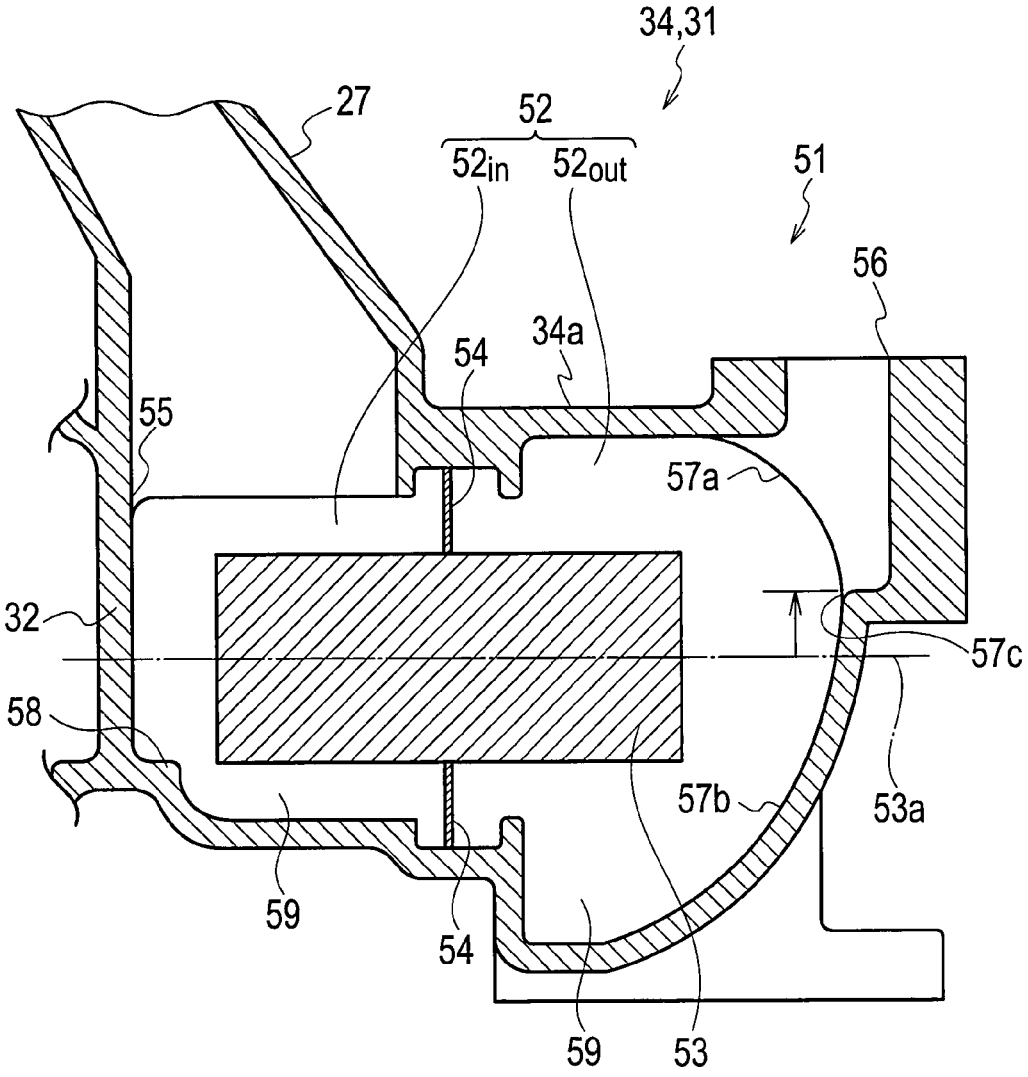
FIG. 6 is an enlarged view of a principal part of an after-cooler in FIG. 2.

As shown in FIGS. 2, 4, and 6, the higher pressure-side cooling case 34 is formed in the shape of a box, and includes a higher pressure-side cooling area 52 inside. A case upper surface 34*a* of the higher pressure-side cooling case 34 has a higher pressure-side inlet 55 through which compressed air ejected from the higher pressure-side compressor 26 flows in and a higher pressure-side outlet 56 through which compressed air in the higher pressure-side cooling area 52 is discharged outside. Moreover, the higher pressure-side cooling area 52 has the higher pressure-side cooling device 53 provided therein.

The higher pressure-side cooling device 53 is inserted and installed in the higher pressure-side cooling area 52 from the bottom toward the top in FIG. 4. Further, in a state in which the higher pressure-side cooling device 53 is installed, a flow path of compressed air is formed along the horizontal direction (lateral direction in FIGS. 2 and 4) inside the higher pressure-side cooling area 52. Moreover, the higher pressure-side cooling device 53 has partitioning walls 54 on upper and lower surfaces and a forward end surface located in the direction of insertion. Further, the partitioning walls 54 partition a space around the higher pressure-side cooling device 53 into an inlet-side cooling area 52in including the higher pressure-side inlet 55 and an outlet-side cooling area 52out including the higher pressure-side outlet 56.

In the inlet-side cooling area 52in, a portion of the higher pressure-side cooling case 34 which faces an inlet-side lower edge portion 53*b* of the higher pressure-side cooling device 53 has a flow-smoother protrusion 58 formed such that a tip of the flow-smoother protrusion 58 is close to the inlet-side lower edge portion 53*b*. The distance between the inlet-side lower edge portion 53*b* of the higher pressure-side cooling device 53 and the flow-smoother protrusion 58 of the higher pressure-side cooling case 34 is preferably as small as possible. However, in this embodiment, the distance between the inlet-side lower edge portion 53*b* and the flow-smoother protrusion 58 is set to a distance enough to prevent the forward end flange portion 53*c* from touching the flow-smoother protrusion 58 when the higher pressure-side cooling device 53 is assembled to the higher pressure-side cooling case 34.

In the higher pressure-side cooling area 52, a drain space 59 is formed under the higher pressure-side cooling device 53.

Figure 7B:
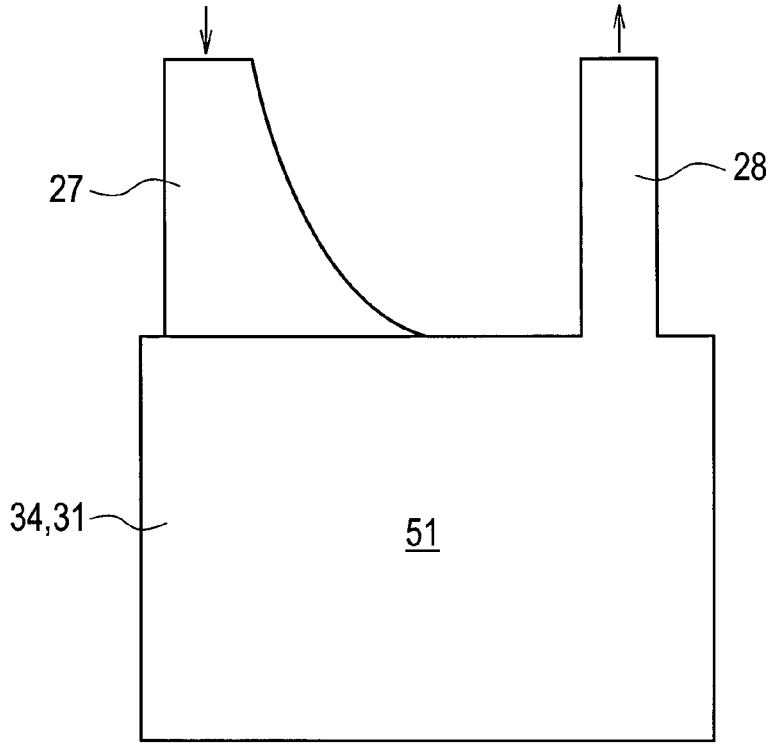
FIG. 7B is a side view of a higher pressure-side cooling case as viewed from the right in FIG. 1.

An inner wall surface of the outlet-side cooling area 52out is an arc-like curved surface extending from the drain space 59 to the case upper surface 34*a*. This arc-like curved surface includes an upper-side inner wall surface 57*a* and a lower-side inner wall surface 57*b* which are defined by a boundary part 57*c* set above a center line 53*a* (center plane extending in a direction perpendicular to the partitioning walls 54) of the higher pressure-side cooling device 53. Here, the curvature of the upper-side inner wall surface 57*a* is set larger than the curvature of the lower-side inner wall surfaces 57*b*. Accordingly, a counter-clockwise air flow with high kinetic energy is generated in a space above the higher pressure-side cooling device 53 which is surrounded by an upper surface of the higher pressure-side cooling device 53, the case upper surface 34*a*, and the upper-side inner wall surface 57*a* as inner walls. Further, this air flow absorbs air which has exited the higher pressure-side cooling device 53 and which has been raised upward by the lower-side inner wall surface 57*b*, and guides the absorbed air to the higher pressure-side outlet 56. Moreover, a higher pressure-side outlet 56 protruding outwardly and opening upwardly is provided above the boundary part 57*c*. As shown in FIG. 7B, a higher pressure-side outlet passage 28 leading from the higher pressure-side cooling area 52 to the outside is connected to the higher pressure-side outlet 56. Further, the higher pressure-side outlet passage 28 is formed to extend in the vertical direction along the upper-side inner wall surface 57*a* both when viewed from the front and when viewed from the side. Accordingly, the direction of the flow of the compressed air which has passed through the higher pressure-side cooling device 53 is changed to an upward direction by the curve of the lower-side inner wall surface 57*b*. Thus, the compressed air is guided to the higher pressure-side outlet 56 along the upper-side inner wall surface 57*a* to be discharged from the higher pressure-side cooling area 52 through the higher pressure-side outlet passage 28 to the outside.

In other words, except the difference in configuration between the upper-side inner wall surfaces 47*a* and 57*a* and the difference in configuration between the lower pressure-side outlet passage 25 and the higher pressure-side outlet passage 28, the intercooler 41 and the after-cooler 51 are configured and disposed to be symmetrical with respect to the division wall 32. Accordingly, as shown in FIG. 2, air compressed by the lower pressure-side compressor 23 enters the lower pressure-side inlet 45 through a lower pressure-side inlet passage 24, passes through the lower pressure-side cooling device 43 to be cooled, and is discharged from the lower pressure-side outlet 46 to the lower pressure-side outlet passage 25 to be introduced into the higher pressure-side compressor 26. Further, compressed air recompressed by the higher pressure-side compressor 26 enters the higher pressure-side inlet 55 through a higher pressure-side inlet passage 27, passes through the higher pressure-side cooling device 53 to be cooled, and is discharged from the higher pressure-side outlet 56 through the higher pressure-side outlet passage 28 to the outside.

It should be noted that since the intercooler 41 and the after-cooler 51 are set such that the lower pressure-side inlet 45 and the higher pressure-side inlet 55 are adjacent to each other with the division wall 32 interposed therebetween, flows of high-temperature compressed air directly after being compressed by compressors are adjacent to each other. This prevents the high-temperature compressed air from warming compressed air after being cooled and reducing cooling efficiency.

In the above-described configuration, since the curvature of each of the inner wall surfaces of the outlet-side cooling areas 42out and 52out is different between above and below the boundary part 47*c* or 57*c*, the flows of compressed air inside the outlet-side cooling areas 42out and 52out are smoothed, and the compressed air smoothly flows inside the cooling devices 43 and 53. Accordingly, the cooling efficiencies of the intercooler 41 and the after-cooler 51 can be improved. Moreover, smoothing the flows of the compressed air in the outlet-side cooling areas 42out and 52out inhibits the raising of condensed water stored in the drain spaces 49 and 59. Thus, the condensed water carried to the downstream side is reduced.

The flow-smoother protrusions 48 and 58, which are set such that the tips thereof are close to the inlet-side lower edge portions 43*b* and 53*b* of the cooling devices 43 and 53, reduce the amount of compressed air entering the drain spaces 49 and 59 set under the cooling devices 43 and 53. Further, the flows of compressed air inside the cooling areas inlet sides 42in and 52in are smoothed, and the compressed air smoothly flows inside the cooling devices 43 and 53. Accordingly, the cooling efficiencies of the intercooler 41 and the after-cooler 51 can be further improved.

In the intercooler 41, the curvature of the upper-side inner wall surface 47*a* is set to 0, and the lower pressure-side outlet 46 is provided on an extension of the upper-side inner wall surface 47*a*. Further, the lower pressure-side outlet passage 25 leading from the lower pressure-side outlet 46 to the outside is formed to extend along the upper-side inner wall surface 47*a* and to extend in the direction oblique to the vertical direction. This reduces the increase in the speed of the compressed air inside the outlet-side cooling area 42out, and the flow of the compressed air is further smoothed. Accordingly, cooling efficiency can be even further improved while pressure loss is reduced.

In the after-cooler 51, the curvature of the upper-side inner wall surface 57*a* is set larger than the curvature of the lower-side inner wall surface 57*b* located below the boundary part 57*c*, and the higher pressure-side outlet passage 28 leading from the higher pressure-side outlet 56 to the outside is formed along the vertical direction. Accordingly, the flow of the compressed air inside the outlet-side cooling area 52out is further smoothed with the compressive strengths of wall surfaces ensured. Thus, cooling efficiency can be even further improved.

Figure 8A:
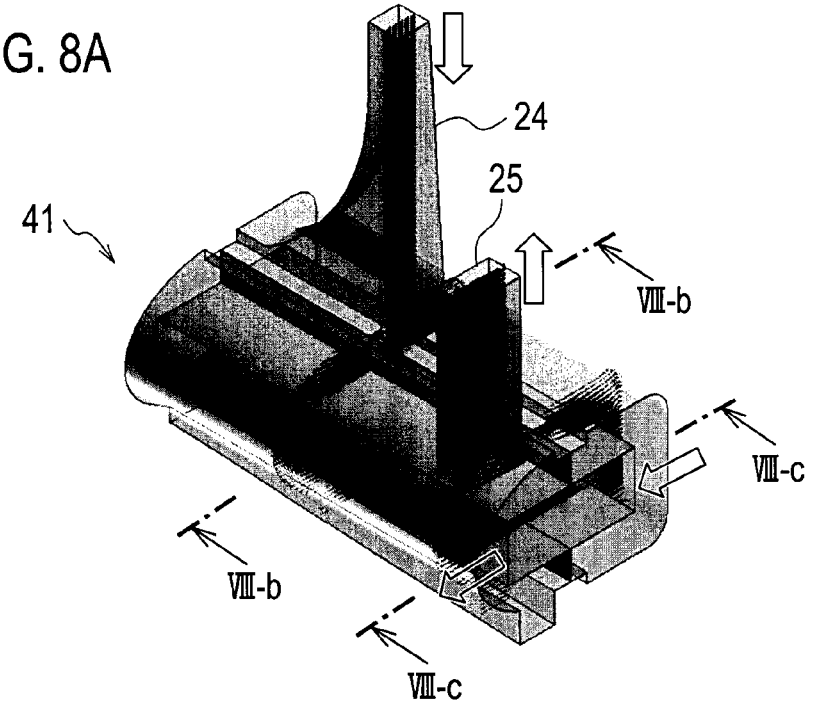
FIG. 8A is a view showing a result of analyzing an air flow field in a cooling case of a compressor with cooling function according to Patent Literature 1.
Figure 8B:
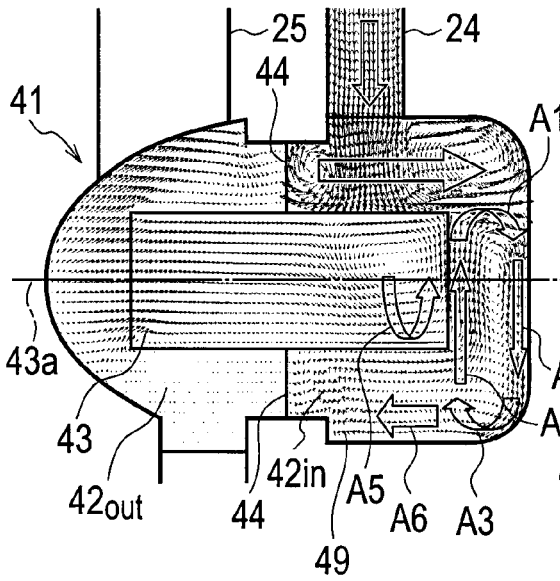
FIG. 8B is a view showing the air flow field in a cross section taken along line VIII-b of FIG. 8A.
Figure 8C:
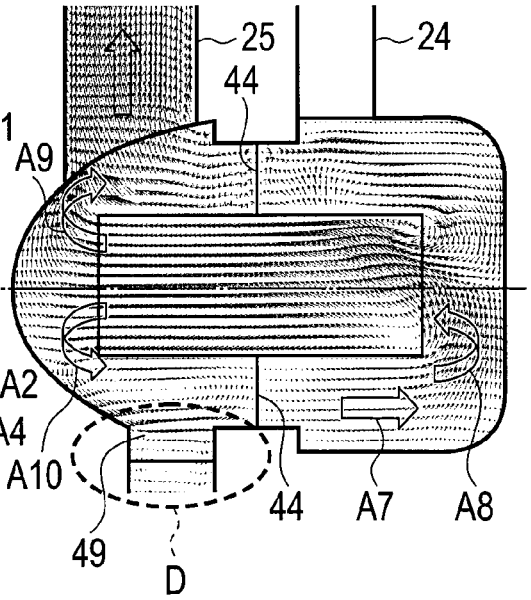
FIG. 8C is a view showing the air flow field in a cross section taken along line VIII-c of FIG. 8A.
Figure 9A:
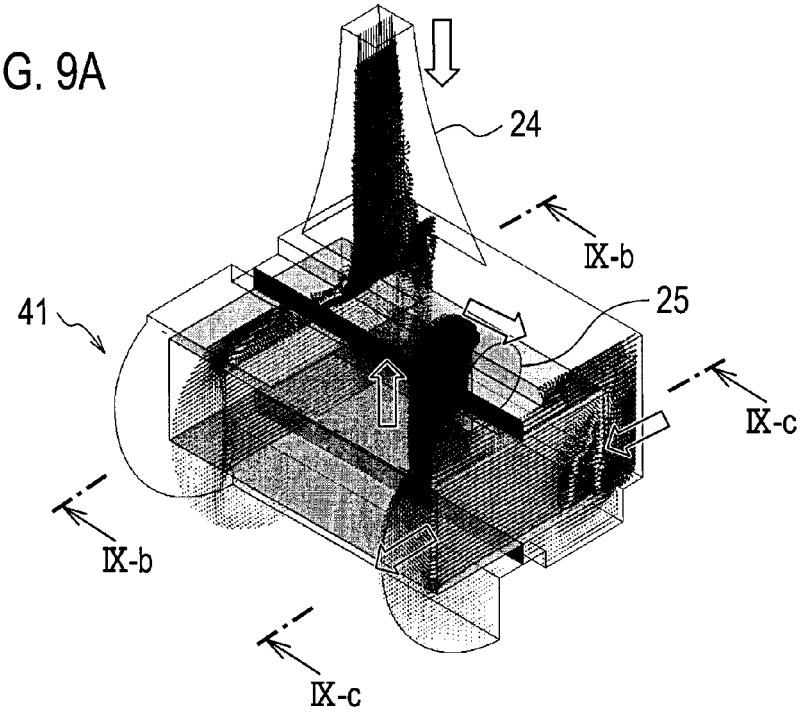
FIG. 9A is a view showing a result of analyzing an air flow field in a cooling case of the compressor with cooling function according to one example of the present invention.
Figure 9B:
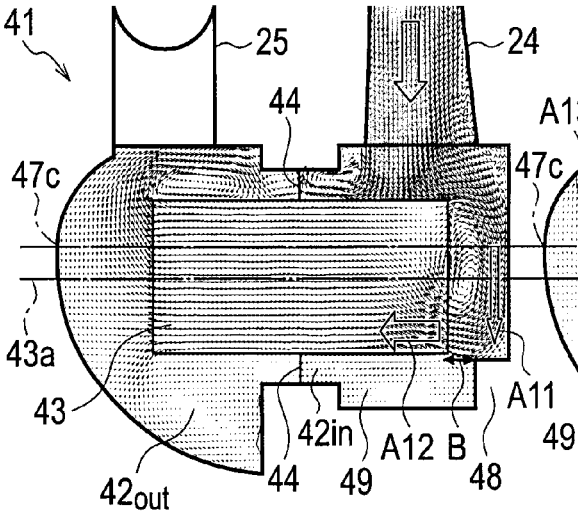
FIG. 9B is a view showing the air flow field in a cross section taken along line IX-b of FIG. 9A.
Figure 9C:
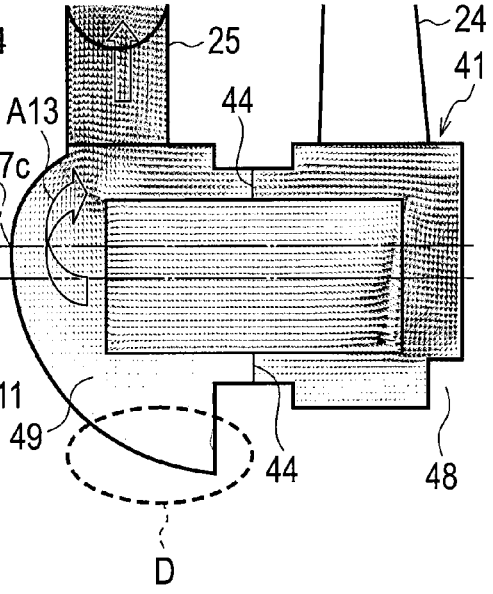
FIG. 9C is a view showing the air flow field in a cross section taken along line IX-c of FIG. 9A.

Next, comparisons will be made between a result of analyzing an air flow field in a cooling case (intercooler and after-cooler) of the compressor with cooling function according to one example of the present invention and a result of analyzing an air flow field in a cooling case (intercooler and after-cooler) of a compressor with cooling function according to Patent Literature 1 with reference to FIGS. 8 and 9. FIG. 8A is a view showing a result of analyzing an air flow field in the cooling case of Patent Literature 1. FIG. 8B is a view showing the air flow field in a cross section (entrance-side cross section) taken along line VIII-b of FIG. 8A. Specifically, the flow of air which has flown into the inlet-side cooling area 42in through the inlet passage 24 is shown. Moreover, FIG. 8C is a view showing the air flow field in a cross section (outlet-side cross section) taken along line VIII-c of FIG. 8A, and shows the flow of air which flows out from the outlet-side cooling area 42out of the cooling case 41 to the outlet passage 25. Similarly, FIG. 9A is a view showing an air flow field in the cooling case of the compressor with cooling function according to the example of the present invention. FIG. 9B is a view showing a result of analyzing the air flow field in a cross section (entrance-side cross section) taken along line IX-b of FIG. 9A. Specifically, the flow of air which has flown into the inlet-side cooling area 42in through the inlet passage 24 is shown. FIG. 9C is a view showing the air flow field in a cross section (outlet-side cross section) taken along line IX-c of FIG. 9A, and shows the flow of air which flows out from the outlet-side cooling area 42out of the cooling case 41 to the outlet passage 25.

From the comparison between FIGS. 8B and 8C and FIGS. 9B and 9C, it can be seen that the example of the present invention and Patent Literature 1 have the following differences. As shown in FIG. 8B, it can be seen that at the entrance-side cross section of the cooling case 41, in a space between the entrance of the cooling device 43 and the side wall of the inlet-side cooling area 42in, there is a clockwise air convection (arrows A1 to A4). Specifically, in this space, the air which has flown in from the inlet passage 24 is directed rightward by the upper surface of the cooling device 43, and further directed downward by the side wall of the inlet-side cooling area 42in (arrow A2). This flow is redirected by the lower surface of the side wall of the inlet-side cooling area 42in (arrow A3) and branched into an upward flow (arrow A4) and a flow (arrow A6) along a lower wall of the inlet-side cooling area 42in. Some of the flow (arrow A6) along the lower wall of the inlet-side cooling area 42in merges into the above-described upward flow (arrow A4) by the clockwise flow in the drain space 49, and other thereof flows parallel to the partitioning wall 44 under the cooling device 43. At the outlet-side cross section of the cooling case 41 shown in FIG. 8C, the air flowing parallel to the partitioning wall 44 becomes the flow directed from the drain space 49 to the cooling device 43 (arrows A7 and A8). Accordingly, it can be seen that in Patent Literature 1, as shown in FIG. 8B, at the entrance-side cross section of the cooling case 41, the amount of air flowing into the cooling device 43 is small, and high cooling efficiency cannot be obtained with this cross section.

On the other hand, in the example of the present invention, as shown in FIG. 9B, the flow-smoother protrusion 48 is provided on the side wall of the inlet-side cooling area 42in of the cooling case 41 on the drain space 49 side. Accordingly, the distance between a corner portion of the cooling device 43 on the drain space 49 side and the flow-smoother protrusion 48 is small (double-headed arrow B). This reduces the entry of air into the drain space 49. Thus, air (arrow A11) which flows into the inlet-side cooling area 42in of the cooling case 41 through the inlet passage 24 to flow downward is smoothly guided to the entrance of the cooling device 43 (arrow A12).

Moreover, from the comparison between FIGS. 8C and 9C, it can also be seen that the example of the present invention and Patent Literature 1 have the following differences. As shown in FIG. 8C, in the example of the present invention, the inner wall surface of the outlet-side cooling area 42out of the cooling case 41 has a shape in which the curvature thereof is symmetric with respect to the center line 43*a* of the cooling device 43. Accordingly, as indicated by arrows A9 and A10, the flow of air directed from the outlet of the cooling device 43 to the outlet-side cooling area 42out is branched into two flows: one is directed above the center line 43*a*, and the other is directed below the center line 43*a* (arrows A9 and A10). Accordingly, air (arrow A10) directed downward flows into the drain space 49, and the blast of the air may raise the condensed water stored in the drain space 49 (region D). Further, the air which has flown into the drain space 49 flows parallel to the partitioning wall 44, and is raised from the drain space 49 along the wall surface of the outlet-side cooling area 42out at the entrance-side cross section of the cooling case 41 shown in FIG. 8B. This causes turbulence.

On the other hand, in the example of the present invention, as shown in FIG. 9C, the inner wall surface of the outlet-side cooling area 42out of the cooling case 41 has the shape of a curved surface having an inflection point 47*c* (point at which the curvature changes) above the center line 43*a* of the cooling device 43 (on the outlet passage 25 side). Here, the inner wall surface above the inflection point 47*c* is referred to as a first inner wall surface, and the inner wall surface below the inflection point 47*c* (on the drain space 49 side) is referred to as a second inner wall surface. Since the inflection point 47*c* is located above the center line 43*a*, air flowing toward the second inner wall surface mostly flows in the direction of the outlet passage 25 (arrow A13). As a result, the flow of air directed to the drain space 49 of the outlet-side cooling area 42out is small. Thus, the risk of the raising of the condensed water stored in the drain space 49 is reduced (region D).

Figure 10A:
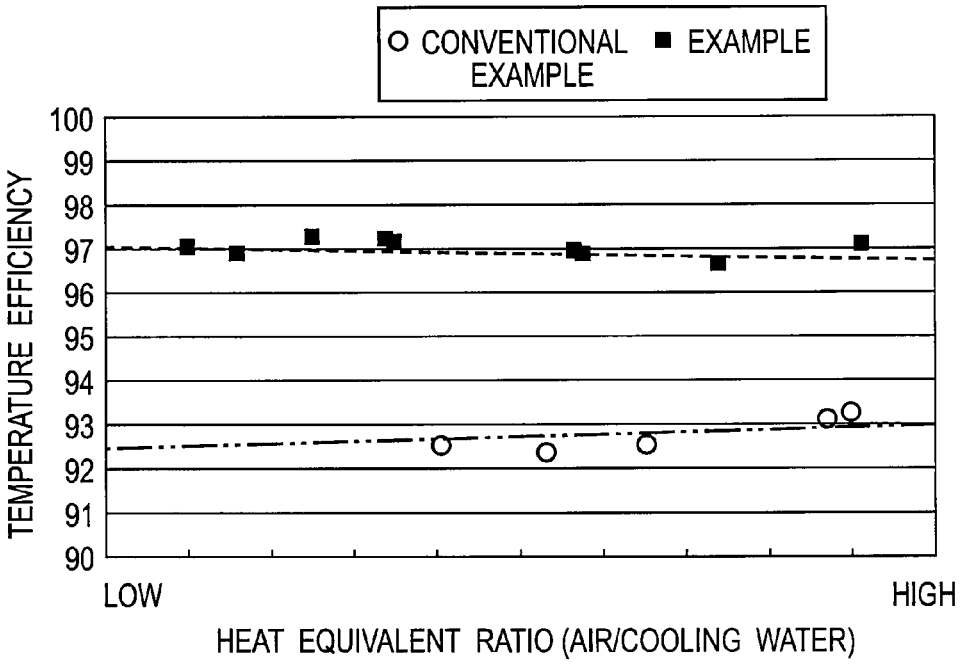
FIG. 10A is a graph showing a result of comparing temperature efficiency characteristics of the intercooler of the compressor with cooling function shown in FIG. 1 according to the example of the present invention and those of an intercooler of the compressor with cooling function according to Patent Literature 1.
Figure 10B:
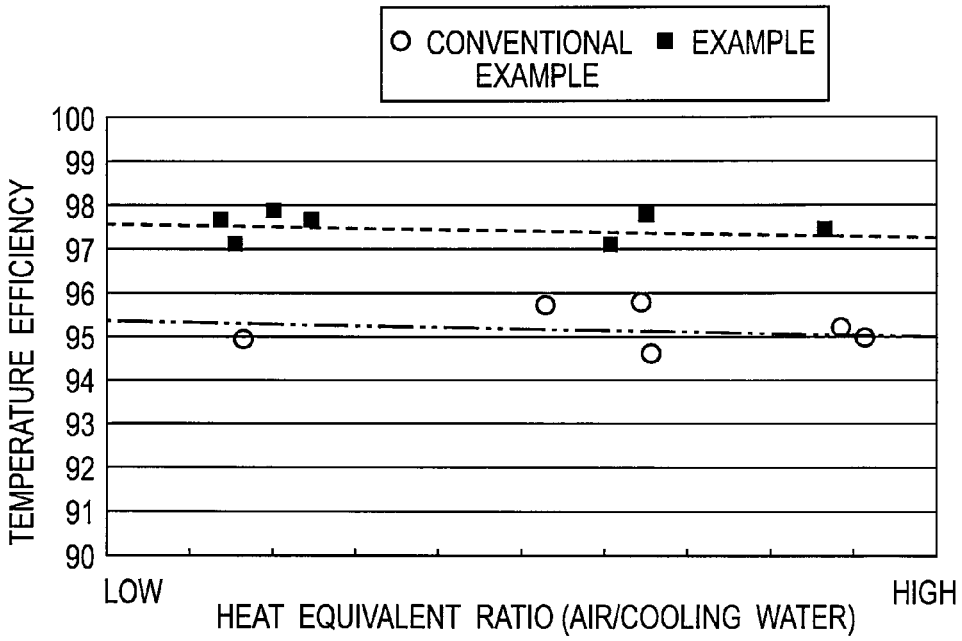
FIG. 10B is a graph showing a result of comparing temperature efficiency characteristics of the after-cooler of the compressor with cooling function shown in FIG. 1 according to the example of the present invention and those of an after-cooler of the compressor with cooling function according to Patent Literature 1.

Finally, a description will be made of practical effects which the above-described differences in the structures of the intercooler 41 and the after-cooler 51 between the example of the present invention and the conventional example have on cooling characteristics thereof. FIG. 10A is a graph showing a result of comparing temperature efficiency characteristics of the intercooler of the compressor with cooling function in FIG. 1 according to the example of the present invention and those of the intercooler of the compressor with cooling function according to Patent Literature 1. FIG. 10B is a graph showing a result of comparing temperature efficiency characteristics of the after-cooler of the compressor with cooling function in FIG. 1 according to the example of the present invention and those of the after-cooler of the compressor with cooling function according to Patent Literature 1. The horizontal axis of each graph indicates heat equivalent ratio (index indicating the magnitude of the ratio of the heat capacity of air to the heat capacity of cooling water), and the vertical axis thereof indicates temperature efficiency. As shown in FIG. 10A, with regard to the intercoolers, both the compressor with cooling function in FIG. 1 as the example and the compressor with cooling function of Patent Literature 1 have almost flat temperature efficiency regardless of the magnitude of the heat equivalent ratio. This tendency is the same in the after-coolers. In conclusion, it can be seen that the intercooler 41 has temperature efficiency improved by approximately 4% on average with respect to the temperature efficiency of the intercooler of the compressor with cooling function of Patent Literature 1, and that the after-cooler 51 has temperature efficiency improved by approximately 2% on average with respect to the temperature efficiency of the after-cooler of the compressor with cooling function of Patent Literature 1.

What is claimed is:

1. A compressor with cooling function, comprising:

a compressing device to be rotationally driven by a drive unit; and a cooler configured to cool compressed air ejected from the compressing device, wherein the cooler comprises:

a case having a cooling area inside;

an inlet provided in an upper surface of the case, the inlet allowing compressed air ejected from the compressing device to flow in;

an outlet provided in the upper surface of the case, the outlet allowing the compressed air to be discharged outside;

a cooling device housed in the cooling area and configured to cool the compressed air;

a partitioning wall partitioning a space around the cooling device in the cooling area into an inlet-side cooling area having the inlet and an outlet-side cooling area having the outlet; and a drain space configured to store condensed water produced from the compressed air cooled when passing through the cooling device, wherein the outlet-side cooling area has an inner wall surface formed of an arc-like curved surface, wherein the inner wall surface includes a first inner wall surface and a second inner wall surface defined by a boundary line being offset toward the inlet and the outlet from a center plane of the cooling device extending in a direction perpendicular to the partitioning wall, the first inner wall surface being an inner wall surface located on the same side as the inlet and the outlet, the second inner wall surface being an inner wall surface located on the same side as the drain space, wherein the first inner wall surface and the second inner wall surface have different curvatures, and wherein a lower surface of the inlet-side cooling area is provided with a flow-smoother protrusion at a position facing a lower edge portion of the cooling device, the flow-smoother protrusion protruding to have a tip thereof located close to the lower edge portion of the cooling device.

2. The compressor with cooling function according to claim 1, wherein the curvature of the curved surface of the first inner wall surface is set to 0, and wherein an outlet passage leading from the outlet to an outside is formed to extend along the first inner wall surface and to extend in a direction oblique to an extending direction of the partitioning wall.

3. The compressor with cooling function according to claim 1, wherein the curvature of the curved surface of the first inner wall surface is set larger than that of the curved surface of the second inner wall surface, and wherein the outlet passage leading from the outlet to an outside is formed to extend along an extending direction of the partitioning wall.

* * * * *